US009057191B2

(12) United States Patent
Meyer et al.

(10) Patent No.: US 9,057,191 B2
(45) **Date of Patent: *Jun. 16, 2015**

(54) ACOUSTICALLY ABSORPTIVE PANEL

(71) Applicant: Meyer Sound Laboratories, Incorporated, Berkeley, CA (US)

(72) Inventors: John D. Meyer, Berkeley, CA (US); Helen Meyer, Berkeley, CA (US); Marcy Wong, Berkeley, CA (US); Deborah Lynne O'Grady, Berkeley, CA (US); Pierre Germain, Berkeley, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 45 days.

This patent is subject to a terminal disclaimer.

(21) Appl. No.: 14/166,645

(22) Filed: Jan. 28, 2014

(65) Prior Publication Data

US 2014/0196981 A1 Jul. 17, 2014

Related U.S. Application Data

(63) Continuation of application No. 13/470,167, filed on May 11, 2012, now Pat. No. 8,636,104.

(60) Provisional application No. 61/485,094, filed on May 11, 2011, provisional application No. 61/643,155, filed on May 4, 2012.

(51) Int. Cl.

| | |
|---|---|
| ***E04B 1/86*** | (2006.01) |
| ***E04B 1/82*** | (2006.01) |
| *E04B 1/84* | (2006.01) |

(52) U.S. Cl.

CPC ..... *E04B 1/8209* (2013.01); *E04B 1/86* (2013.01); *E04B 2001/8281* (2013.01); *E04B 2001/8452* (2013.01); *E04B 2001/8471* (2013.01)

(58) Field of Classification Search

CPC . E04B 1/8209; E04B 1/86; E04B 2001/8471; E04B 2001/8452; E04B 2001/8281

USPC ..... 181/30, 286, 288, 290, 291, 295; 52/144

See application file for complete search history.

(56) References Cited

U.S. PATENT DOCUMENTS

| | | | | | |
|---|---|---|---|---|---|
| 2,017,548 | A | * | 10/1935 | Rosenblatt | 52/145 |
| 2,556,884 | A | * | 6/1951 | Muller | 181/290 |
| 2,954,838 | A | * | 10/1960 | Nuorivaara | 181/290 |
| 4,213,516 | A | * | 7/1980 | Sulewsky | 181/286 |
| 4,531,609 | A | * | 7/1985 | Wolf et al. | 181/290 |
| 4,605,088 | A | * | 8/1986 | Sickels | 181/30 |
| 4,702,046 | A | * | 10/1987 | Haugen et al. | 52/144 |

(Continued)

*Primary Examiner* — Jeremy Luks

(74) *Attorney, Agent, or Firm* — Beeson Skinner Beverly, LLP

(57) ABSTRACT

An acoustically absorptive panel comprises a forward air-space bounded by an acoustically transparent front fabric stretch-mounted on a support frame, and the front face of a porous acoustical absorber, the forward air space, the front fabric and the porous absorber collectively acting as acoustical absorbing chamber, wherein oppositely disposed end panels of the front fabric extend around opposing side frame members of one or more frame structures of the support frame and are connected to a pair of spaced apart retaining struts disposed between the side frame members, the distance between the retaining struts adjustable by rotating one or more threaded tension adjusters thereby stretching or relaxing the front fabric across the support frame to adjust the frequency at which sound absorption will be maximized.

12 Claims, 12 Drawing Sheets

(56) References Cited

U.S. PATENT DOCUMENTS

| | | | | | |
|---|---|---|---|---|---|
| 4,971,850 | A * | 11/1990 | Kuan-Hong | ..... | 428/137 |
| 5,317,113 | A * | 5/1994 | Duda | ..... | 181/285 |
| 5,492,749 | A * | 2/1996 | Solves et al. | ..... | 428/172 |
| 5,665,943 | A * | 9/1997 | D'Antonio | ..... | 181/295 |
| 6,015,026 | A * | 1/2000 | McGrath | ..... | 181/295 |
| 6,244,378 | B1 * | 6/2001 | McGrath | ..... | 181/292 |
| 6,321,871 | B1 * | 11/2001 | Russell | ..... | 181/295 |
| 8,636,104 | B2 * | 1/2014 | Meyer et al. | ..... | 181/286 |
| 2005/0263346 | A1 * | 12/2005 | Nishimura | ..... | 181/290 |
| 2005/0279574 | A1 * | 12/2005 | Halterbeck et al. | ..... | 181/293 |
| 2007/0125011 | A1 * | 6/2007 | Weir et al. | ..... | 52/144 |

* cited by examiner

| Frequency | Absorption Coefficient |
|---|---|
| 63 | 0.00 |
| 125 | 0.00 |
| 250 | 0.00 |
| 500 | 0.06 |
| 1000 | 0.66 |
| 2000 | 0.20 |
| 4000 | 0.22 |
| 8000 | 0.43 |

ACOUSTICALLY ABSORPTIVE PANEL

CROSS-REFERENCE TO RELATED APPLICATIONS

This application is a continuation of prior application Ser. No. 13/470,167, filed May 11, 2012, which claims the benefit of U.S. Provisional Application No. 61/485,094, filed May 11, 2011, and of U.S. Provisional Application No. 61/643,155, filed May 4, 2012.

BACKGROUND

Acoustically absorptive materials are used to dampen noise in commercial, industrial and residential settings. Reduced noise in commercial and industrial areas creates a healthier and more productive work environment, and sound dampening materials in the family home can make for more pleasant and relaxing surroundings.

Acoustically absorptive materials consist mainly of porous absorbers and membrane absorbers. Porous absorbers include mineral fibers, such as fiberglass insulation, foams, such as melamine foam, carpeting, textiles, insulators, such as cotton insulation, and wood fiber board products. The absorptive effect of the porous absorbers is based on the fact that sound is able to enter the open structures of the material where, due to the friction of air particles, the sound energy is converted into thermal energy at the surface of the pores. Porous absorbers achieve their best effect at medium and high frequencies.

While porous absorbers may be effective at sound absorption, they typically do not present an aesthetically pleasing appearance. Although melamine foam and cotton insulation products are available in different colors, they do not have facings capable of retaining an aesthetically acceptable printed image. Melamine foam is, however, available in a variety of surface patterns, including a pyramid pattern available from Pinta Acoustic, Inc. under the SONEXpyramid brand, whereas fiberglass and cotton insulation are generally available only in flat panels. Fiberglass panels are normally wrapped in an acoustically transparent fabric which can be obtained in solid colors or imprinted with a pattern.

Membrane absorbers create and employ an associated air space to absorb sound. The combination of a membrane absorber and adjacent air space works as a mass-spring system in which mass is provided by the membrane and the associated air space and a spring property results from the spring-like quality of the membrane and the stiffness of the air together. Examples of membrane absorbers are acoustic tile ceilings, gypsum board walls and ceilings, and stage structures. Membrane absorbers have been combined with a porous absorber disposed inside the associated air space to provide sound absorption through a wider range of frequencies.

Some sound absorbing systems use stretched fabric acoustic absorbers. Several fabric acoustic absorbers are available, such as from Wall Technology, Inc. under the Eurospan® brand, from Stretchwall Installations, Inc. under the Stretchwall® brand, from Clipso S.A. Corporation under the Clipso® brand, and from Novawall Systems, Inc., under the Novawall® brand. Sound absorbing systems using such stretched fabric acoustic absorbers are typically field installed using proprietary frames over which the fabric is stretched, the frames frequently having grooves into which the fabric is tucked to tension it. These systems are generally mounted on an entire wall or ceiling, as opposed to a smaller discrete area, using mounting systems directed to covering entire wall surfaces. A small air space between the insulation and the fabric in these prior art systems allows the fabric to be stretched and ensures a flat finish.

Traditional acoustic panels generally use fabrics that are not suitable for printing, but which can take on a solid color, although it is known to use patterned fabrics. A system consisting of a printed fabric attached to an aluminum frame with a flat foam acoustically absorbent panel inside the frame is available from CCS Digital Fabric, GmbH under the Fabric_Frame® brand.

None of the prior art acoustically absorbent systems provides for the ability to effectively tune the sound absorbing qualities of the system to dampen selected sound frequencies. Prior art wall systems having sound absorbing capabilities typically do not have a front surface able to accept a printed graphic image. In addition, no prior art sound absorbing wall system exists that provides a product suitable for installation in a discrete area smaller than the full expanse of an entire wall or ceiling. There is, therefore, a need to develop an acoustical wall panel system with improved sound absorbing capabilities that is appropriate for hanging on a wall surface or a similar type of readily removable installation.

SUMMARY OF THE INVENTION

The invention differs from all of the prior art systems in that it involves combining a porous absorber with a membrane absorber by mounting a printable, stretched fabric on a frame which contains a porous absorber. The combination of the front fabric and the resulting air cavity that is created between the porous absorber and the fabric results in additional absorption compared to the absorption properties of the underlying porous absorber alone. The new acoustically absorptive panel can also be tuned to select which frequencies to dampen depending on the type of the front fabric, the tension of the fabric, and the separation of the fabric from the porous absorber.

BRIEF DESCRIPTION OF THE ILLUSTRATIONS

DETAILED DESCRIPTION OF THE ILLUSTRATED EMBODIMENT

Figures 1, 1A, 2:
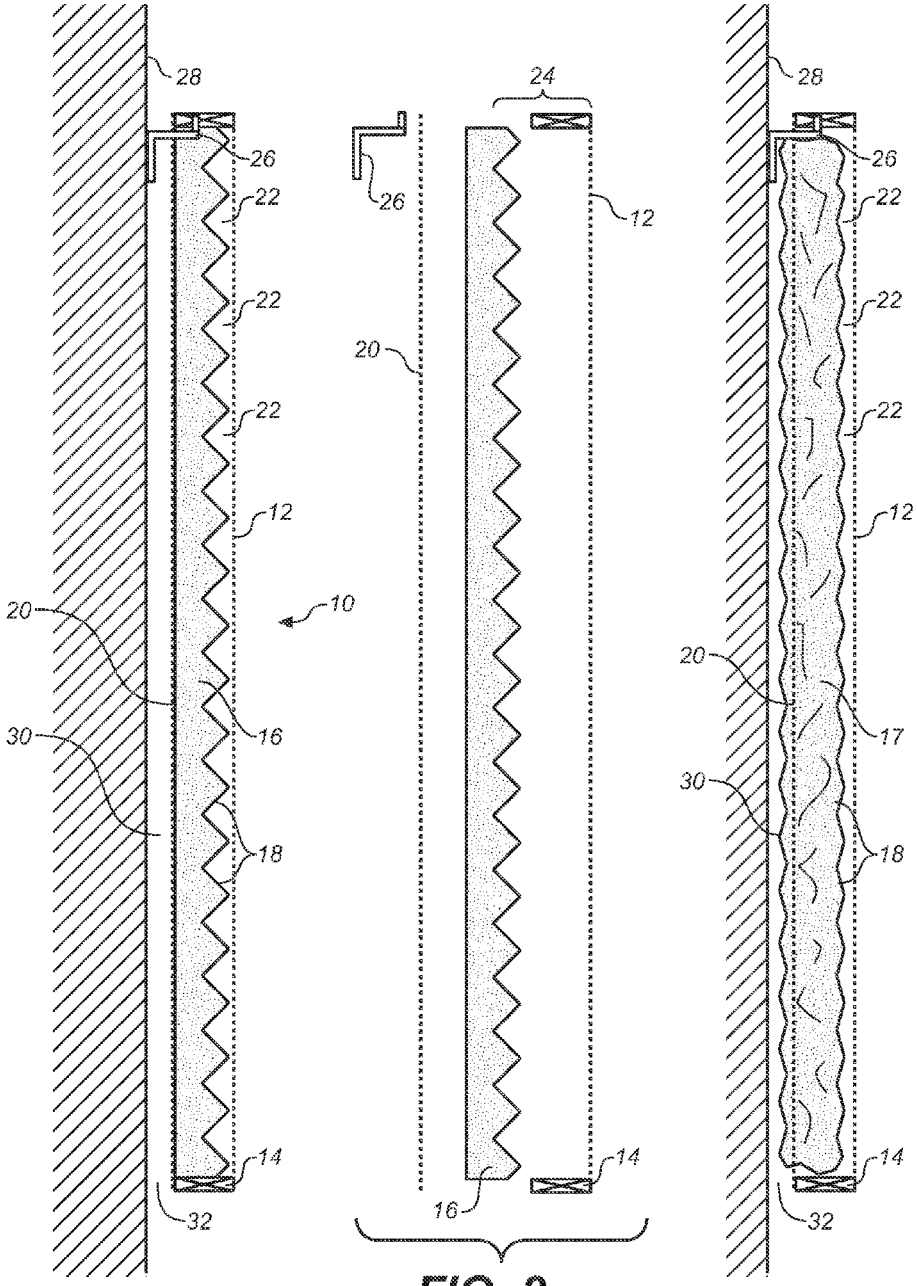
FIG. 1 is a side sectional view of an acoustically absorptive panel showing a printable surface over an acoustically absorptive foam panel according to the invention.
FIG. 1A is a side sectional view of an alternate embodiment of the invention showing a printable surface over an acoustically absorptive panel comprising a substance other than foam.
FIG. 2 is an exploded view of the acoustically absorptive panel with printable surface shown in FIG. 1.

An acoustically absorptive panel with a printable surface according to the invention is referred to generally at 10 in FIG. 1. The invention combines the advantages of membrane absorbers and porous absorbers and comprises an acoustically transparent printable front fabric 12 stretch-mounted on a support frame 14 over an acoustically absorptive foam panel 16. The invention enables the displaying of a high-quality image on a flat surface, such as a wall, which absorbs sound frequencies in addition to what would be possible were only foam absorbers to be used. Advantageously, the panel may be "tuned" to absorb a selected band of frequencies. For purposes of this application, the phrase acoustically transparent shall be understood to mean that, with respect to sound waves passing through the material, there should be no more than 1.0 dB of attenuation in any ⅓ octave band from 2500 Hz and below, and no more than 2.0 dB attenuation in the 3150 Hz ⅓ octave band and above. Fabrics that exceed this criteria by no more than 1 dB in any ⅓ octave band are also suitable for this invention, provided that the acoustic absorption properties of such fabrics and the underlying porous absorber together are equal to or greater than those of the underlying porous absorber alone.

The front fabric 12 is capable of being stretched across a support frame 14 and it also has a texture suitable for retaining a printed graphic image. The foam panel 16 may be supported by frame 14 or, in other embodiments, by independent means such as a separate frame or other suitable support means. In the illustrated embodiment, the foam panel 16 has a facing 18 with a pyramid pattern as shown in FIG. 1. Melamine foam panels with a pyramid facing, such as those available from Pinta Acoustic, Inc., are suitable for this application. Pyramid foam panels can typically be obtained in thicknesses of 2", 3" and 4". Those of skill in the art will understand that porous absorbers other than a melamine foam panel having a pyramid facing may be used depending on the degree of absorption required. Other suitable porous absorbers 17 according to the invention include fiberglass insulation, rockwool, mineral wool, flat foam, or cotton batting as shown in FIG. 1A.

The foam panel 16 in the illustrated embodiment is supported by a rear backing fabric 20 to which the foam panel 16 may be glued. The backing fabric 20 does not need to be acoustically transparent, and those of skill in the art will understand that a backing fabric may not always be necessary.

The stretched front fabric 12 may be mounted so that it is spaced a selected distance from the foam panel 16 to create a forward air space 22 or cavity. The front fabric 12 is a membrane absorber which, together with the resultant air space 22, works as a mass-spring system to absorb sounds in the mid-to-low frequencies. If the weight of the front fabric material is increased, a lower resonant frequency will result. Likewise, if the depth of the airspace is increased, the resonant frequency will be lower. Thus, the acoustically absorptive panel may be tuned to absorb a selected band of frequencies by selecting a suitable porous absorber, designating a thickness therefore, setting the depth of the forward air space 22, and selecting the thickness or weight of the front fabric 12. Anticipating that the maximum depth of the entire acoustically absorptive panel from the wall to the front panel will be no more than 4" as an aesthetic limit, the porous absorber will be between 1" and 3" thick, and the forward air space 22 will be between approximately 1" and 3" according to the invention.

With reference to FIGS. 1 and 2, the forward air space 22 in the illustrated embodiment includes pyramid-shaped air cavities defined by the pyramid facing 18 of the foam panel 16 and the front fabric 12. The forward air space 22, foam panel 16, and front fabric 12 collectively form and act as a forward acoustical absorbing chamber 24. The frequencies absorbed by the forward acoustical absorbing chamber 24 can be controlled by varying the depth of the forward air space 22. Generally, increasing the depth of the air space 22 lowers the range of frequencies that are absorbed. The acoustically absorptive properties of the forward acoustical absorbing chamber 24 also depend on the thickness and flexibility of the front fabric 12, and the tautness or tension of the front fabric which is a function of how firmly it is stretched over the support frame 14. Applying tension to the front fabric 12 will allow "tuning" of the panel much like a drum head. Increasing the tension will result in a higher resonant frequency, and therefore the frequency at which the sound absorption will be maximized. Applicants have determined that a knit 100% polyester fabric having a weight of between 5.0 and 6.2 ounces per square yard, and a thickness of between approximately 15 and 16 mils, such as is available under the Neschen DirectTex Pro-Poplin brand from Neschen AG, located in Bückeburg, Germany, is suitable for use as the front fabric 12 since it is acoustically transparent according to the definition given above and is capable of retaining a printed image even when tensioned. The front fabric 12 should be stretched at least enough to pull the fabric taut and free of wrinkles. The maximum tension which should be applied to the front fabric according to the invention is 17 lbs of tension per linear inch which will result in approximately a 15% elongation of the material lengthwise and across its width.

The support frame 14 is set or mounted on brackets 26 attached to a wall 28. The support frame 14 may be mounted so that it abuts the wall 28 or it may be spaced a selected distance from the wall to form a rear air space 30 between the wall 28 and the foam panel 16. The rear air space 30 acts as a rear acoustical absorbing chamber 32 which absorbs sounds that have penetrated the front fabric 12, the foam panel 18 and the backing fabric 20. In one embodiment, the rear acoustical absorbing chamber has a depth of 40 mm, but those of skill in the art will recognize that other mounting depths fall within the scope of the invention as may be determined by aesthetic and acoustical absorption requirements.

Figure 3:
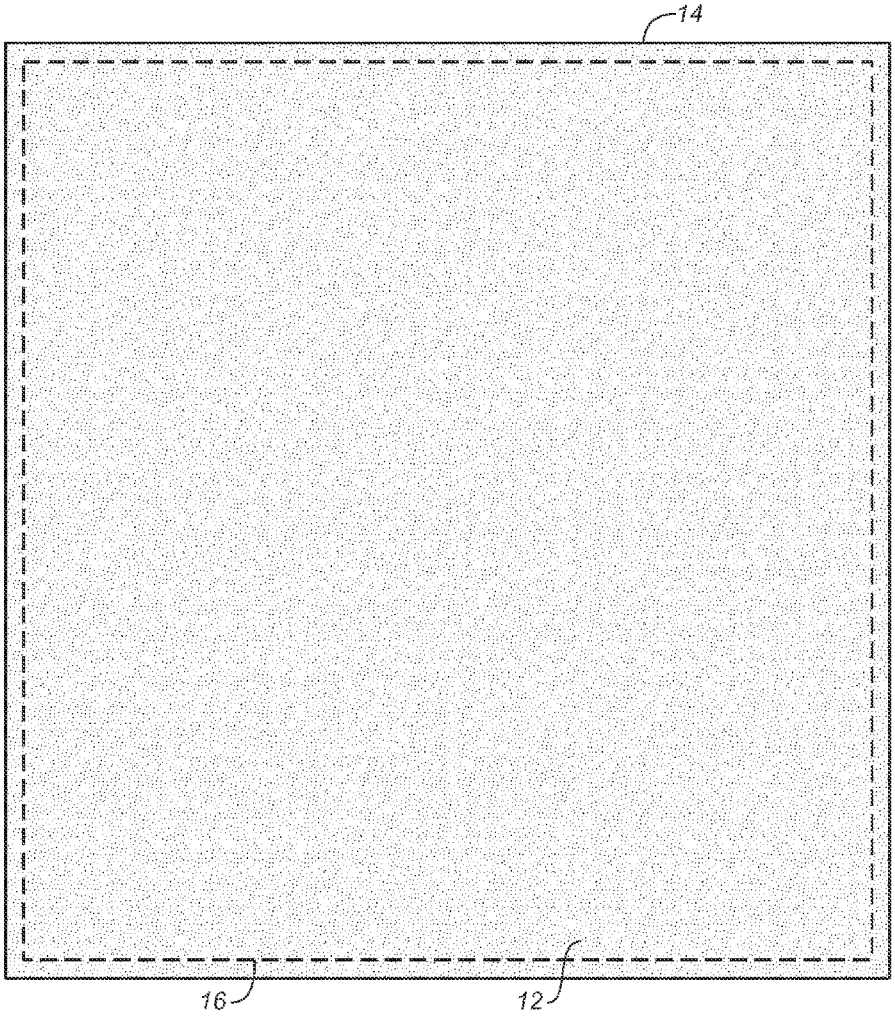
FIG. 3 is a front elevational view of the acoustically absorptive panel with printable surface shown in FIG. 1.

FIG. 2 is an exploded view of the basic components of the invention: the front fabric 12, support frame 14, foam panel 16, backing fabric 20, and mounting brackets 26. FIG. 3 is a front view of an acoustically absorptive panel 10 showing the printable front fabric 12, the edge of the support frame 14, and the foam panel 16 in dashed lines.

The absorptive effectiveness of the acoustically absorptive panel 10 can be controlled by selecting the properties of the front fabric, controlling its tautness, varying the depth of the forward acoustical absorbing chamber 24, selecting the thickness of the foam panel 16, and varying the depth of the rear acoustical absorbing chamber 32. In most embodiments the distance between the front fabric 12 and a wall surface 28 would be no more than six inches due to practical framing requirements and an aesthetic limit would be no more than 4". But embodiments mounted horizontally on ceilings could be spaced from the structural ceiling by as much as four feet.

Figure 6A:
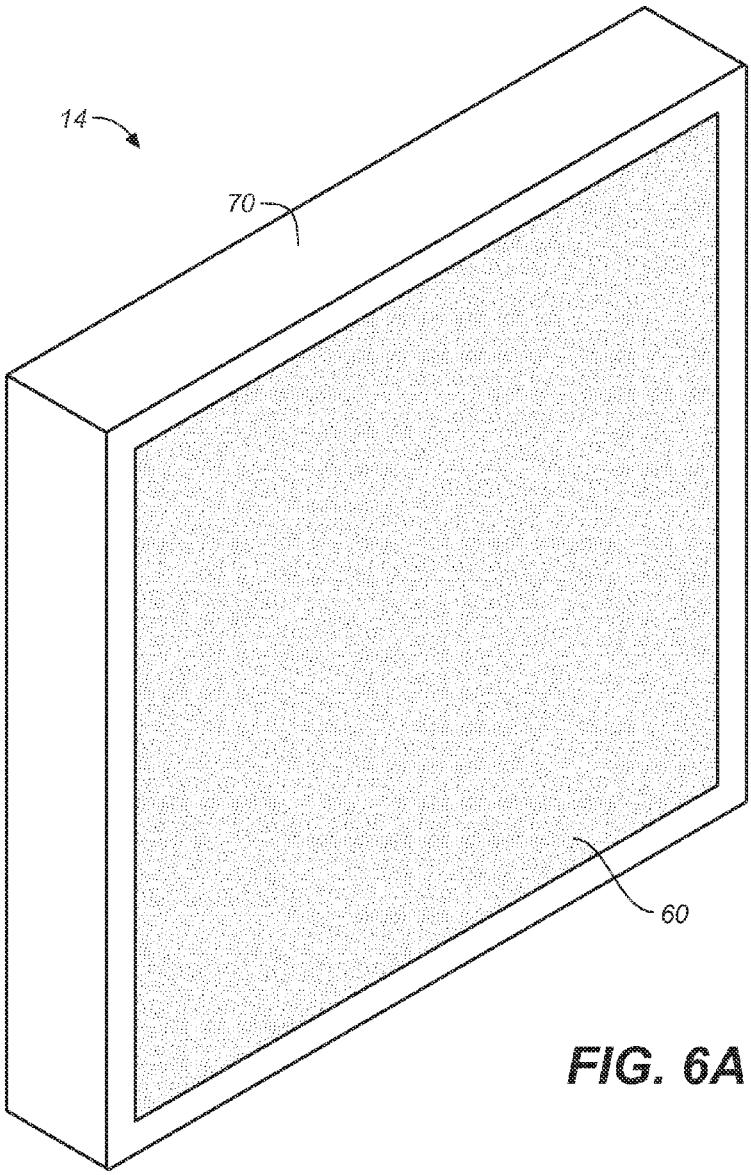
FIG. 6A is an upper perspective view of an acoustically absorptive panel according to the invention showing a stretched printable front fabric and a decorative frame.

In one aspect of the invention, a frame 14 is described in greater detail with respect to FIGS. 6A-12. FIG. 6A shows another embodiment of an acoustically absorptive panel showing a front fabric 60 and a decorative frame 70. FIG. 6B shows decorative frame 70 removed to reveal a front frame structure 40F stacked over a rear frame structure 40R, the front fabric 60 stretch mounted on the front frame structure 40F. The front and rear frame structures 40F, 40R are fixed to each other by fasteners at each of the mutual four corners thereof as seen in FIG. 7B. It is anticipated that the frame structures 40F, 40R will be manufactured from aluminum due to its lightness, strength and rigidity, but other materials may be used such as other metals and woods depending on the application.

Figure 7A:
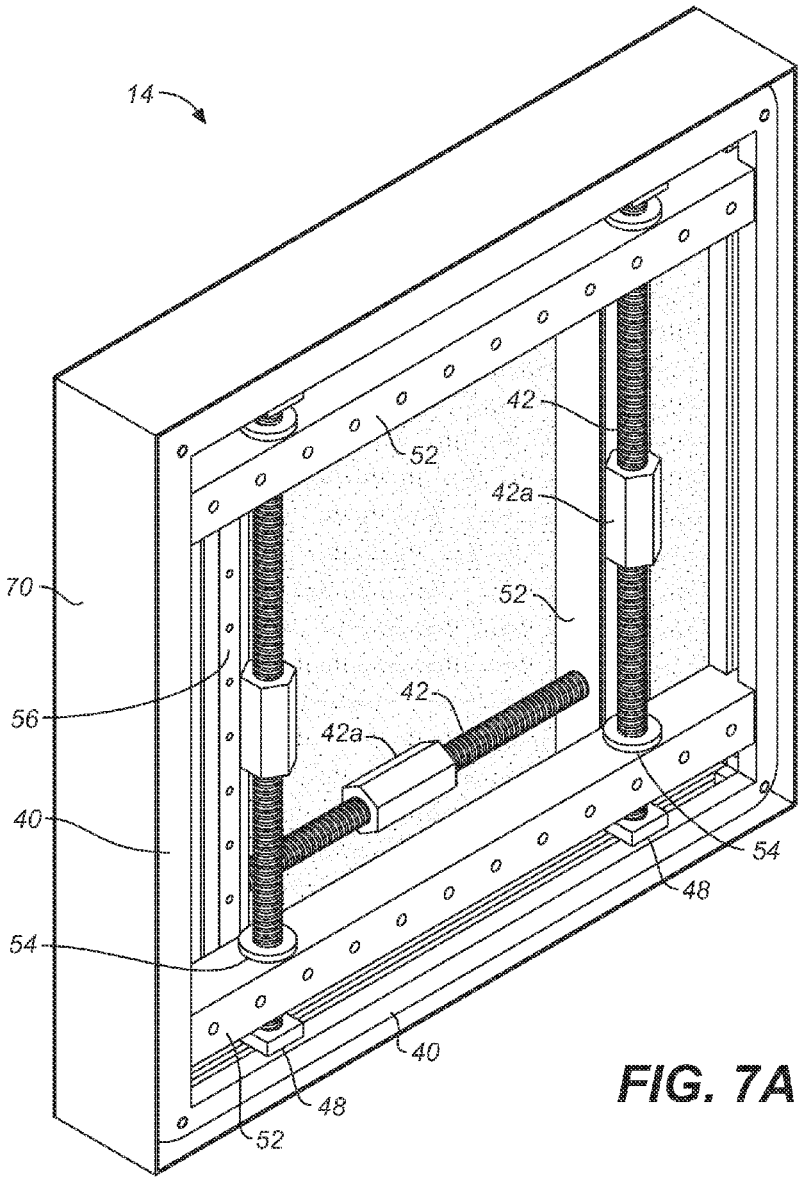
FIG. 7A is an upper perspective view of the back side of the acoustically absorptive panel shown in FIG. 6A.
Figure 7B:
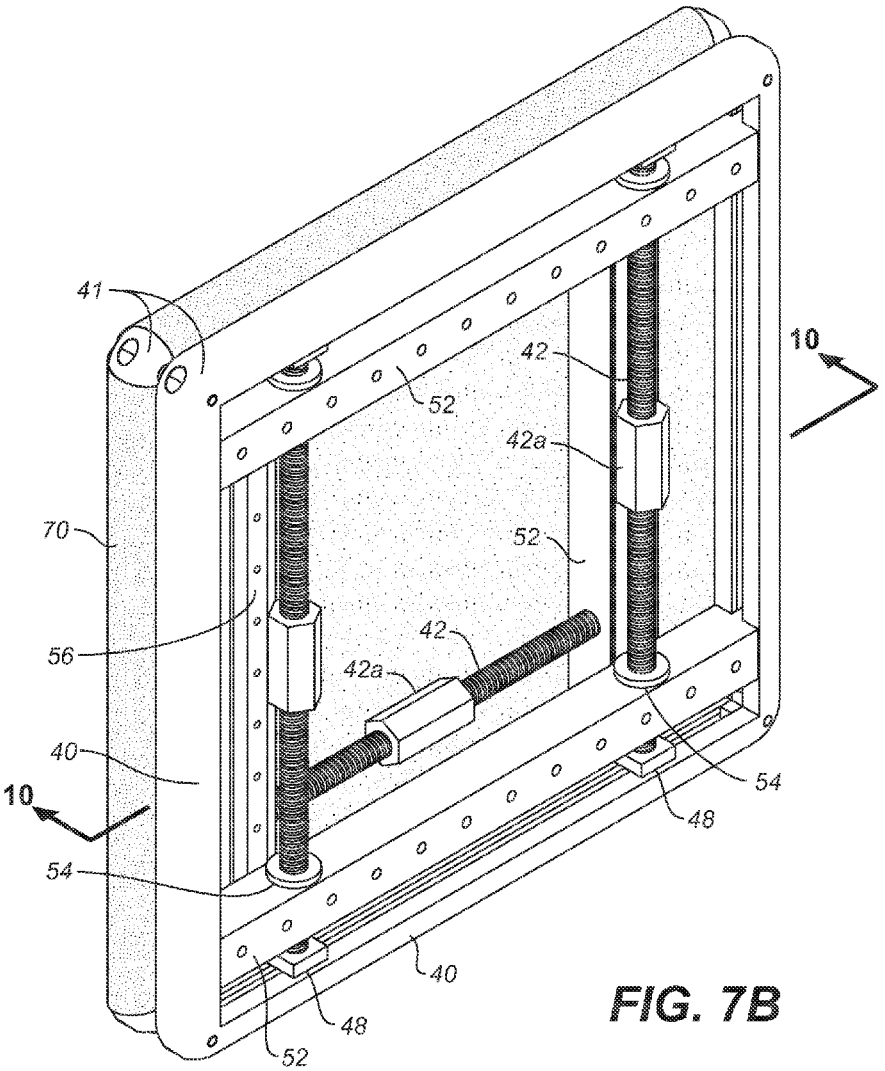
FIG. 7B is upper perspective view of the back side of the acoustically absorptive panel shown in FIG. 7A with the decorative frame removed.

FIGS. 7A and 7B show a rear view of the acoustically absorptive panel shown in FIG. 6A with the decorative frame in place and removed, respectively. Each frame structure 40F, 40R has an overall rectilinear shape and curved outer surfaces 41 to facilitate wrapping and tensioning the front fabric 60 around the frame structure as discussed below. Opposing frame side members of frame structure 40F, 40R are interconnected by tension adjusters such as threaded lead screw 42. Each half of lead screw 42 includes threads that are formed in a mirror image of the threads on the other half thereof. A pillow block thrust bearing 48 is provided on each end of the lead screw 42 and is rotatably affixed to the inner surface 50 of the frame member 40 such that the lead screws 42 are freely rotatable yet maintained at a fixed distance with respect to each other.

Figure 11:
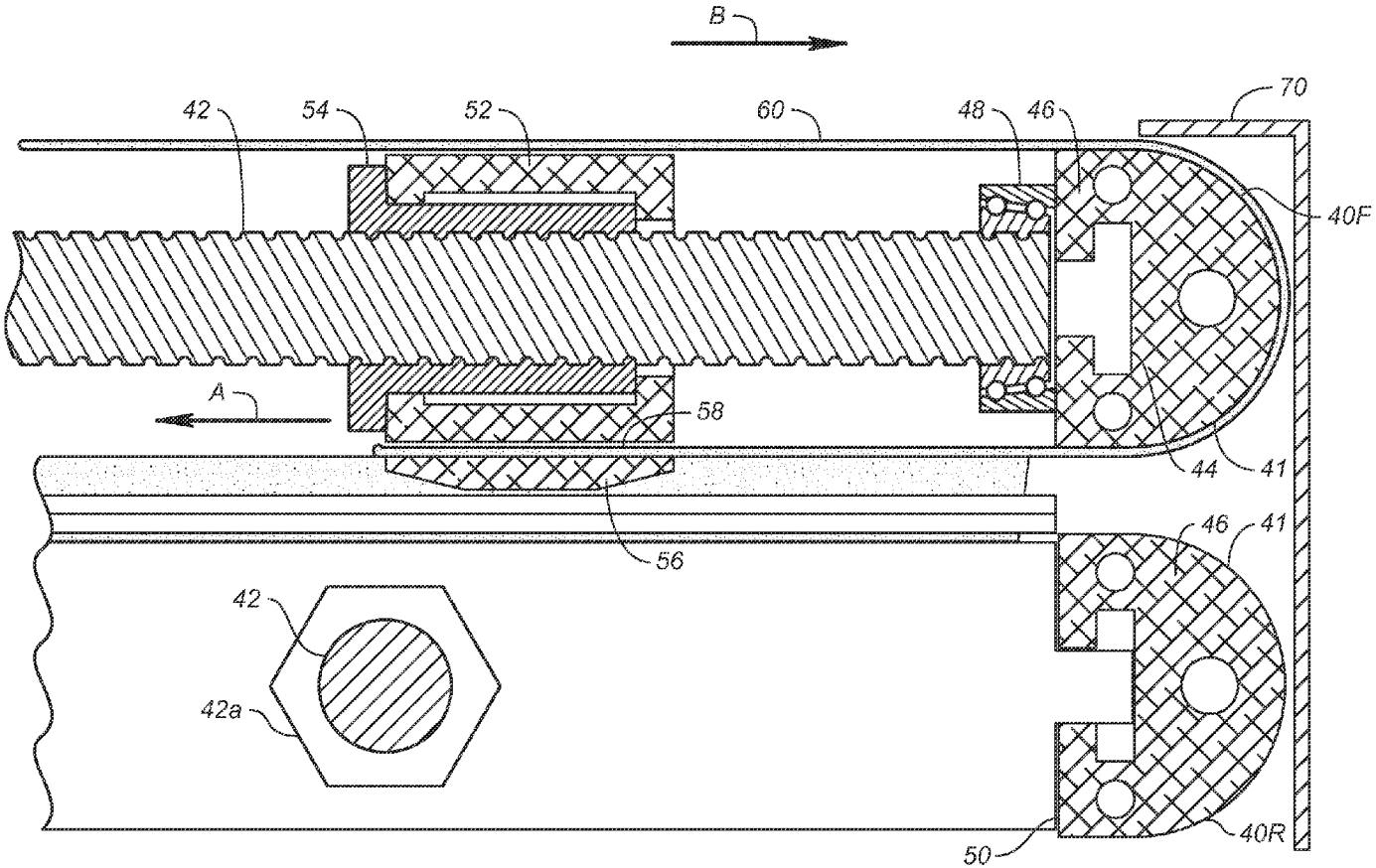
FIG. 11 is a close up sectional view of the ends of the frame members of the taken acoustically absorptive panel shown in FIG. 9A taken along lines 11-11 thereof.

A retaining strut 52 extends parallel with and inwardly spaced from each frame side member as shown in FIGS. 7A, 7B and 11. Each lead screw 42 is rotatably received in an opening in the tension strut 52 and threadedly received in a ball nut 54 affixed to the retaining strut. Thus, by rotating the lead screw in a selected direction the tension struts 52 can be moved toward or away from each other.

Each retaining strut 52 is also equipped with one or more clamping plates 56 for securing one end panel 58 of fabric 60 to the retaining strut 52. When opposite end panels of a front fabric 60 have each been secured to the tension struts 52 associated with each of a pair of opposing frame side members of frame structure 40F, rotating the lead screw 42 in a direction that pulls the tension struts 52 toward each other in direction A will impose tension on the fabric 60 that is stretched between opposing frame side members of frame structure 40F in direction B as shown in FIG. 11.

Figure 9A:
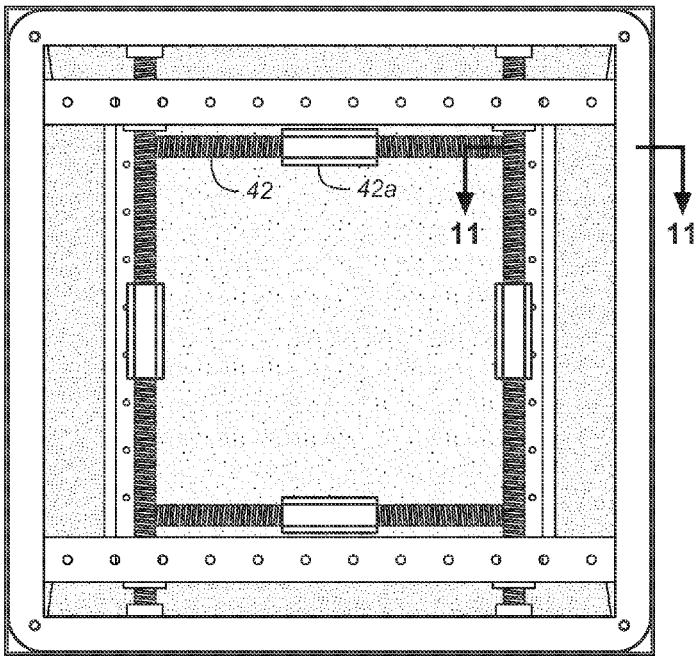
FIG. 9A is a rear elevation view of acoustically absorptive panel shown in FIG. 7A.
Figure 9B:
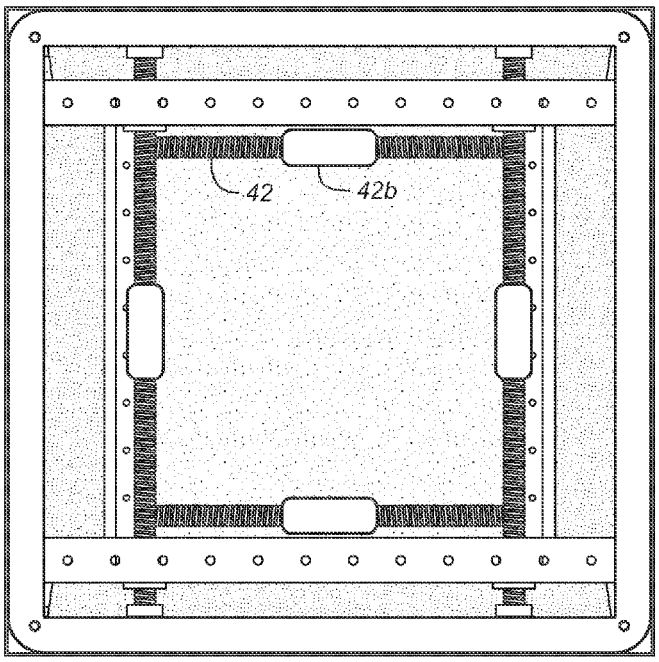
FIG. 9B is a rear elevation view of another embodiment of an acoustically absorptive panel similar to that shown in FIG. 7A but showing motors for operating the lead screws.
Figure 10:
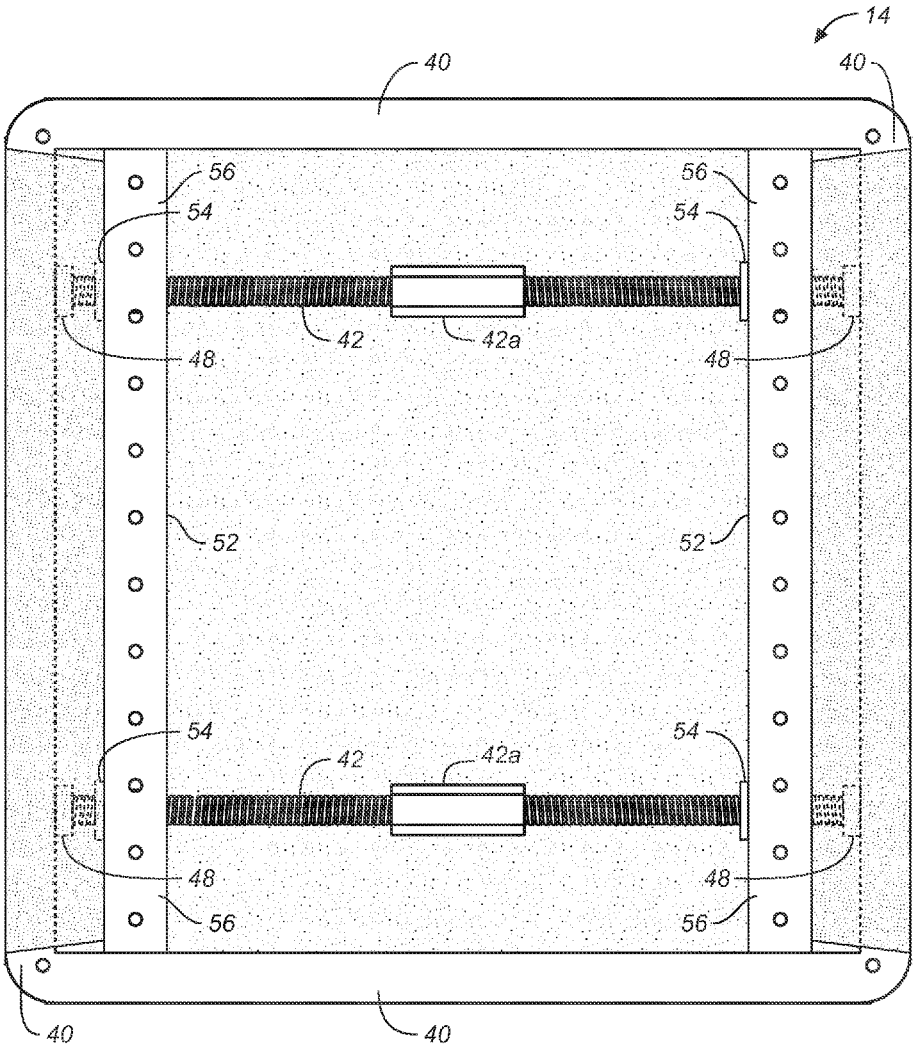
FIG. 10 is a sectional view of the acoustically absorptive panel shown in FIG. 7B taken along lines 10-10 thereof.

A corresponding tensioning system with like parts is provided between the sides of rear frame 40R but with all component parts disposed perpendicularly to the component parts of the tensioning system which are described with respect to front frame 40F. In addition, whereas the clamping bar 56 is disposed to the rear of retaining struts 52 in the tensioning system of front frame structure 40F, the clamping bar 56 is disposed forward of the retaining struts that are part of the tensioning system of the rear frame structure 40R. Thus, the opposite edges of the front fabric 60 extending in a first direction may be wrapped around the front frame structure 40F, between the front and rear frame structures 40F, 40R, and clamped behind the retaining struts 52 thereof and the opposite edges of the front fabric 60 extending in a perpendicular second direction may be wrapped around the front frame structure 40F, also between the front and rear frame structures 40F, 40R, and clamped in front of the retaining struts 52 of the rear frame structure 40R. This enables stretching and tensioning of the front fabric 60 along perpendicularly related axes. It is anticipated that the lead screws 42 may be manually operated using a ratchet 42*a*, as shown in FIGS. 7A, 7B, and 9A, or a motor 42B may be employed as shown in FIG. 9B. The motorized version of the frame may controlled remotely which would allow "tuning" of the acoustically absorptive panel without needing to remove the panel from a mounted location.

Figure 6B:
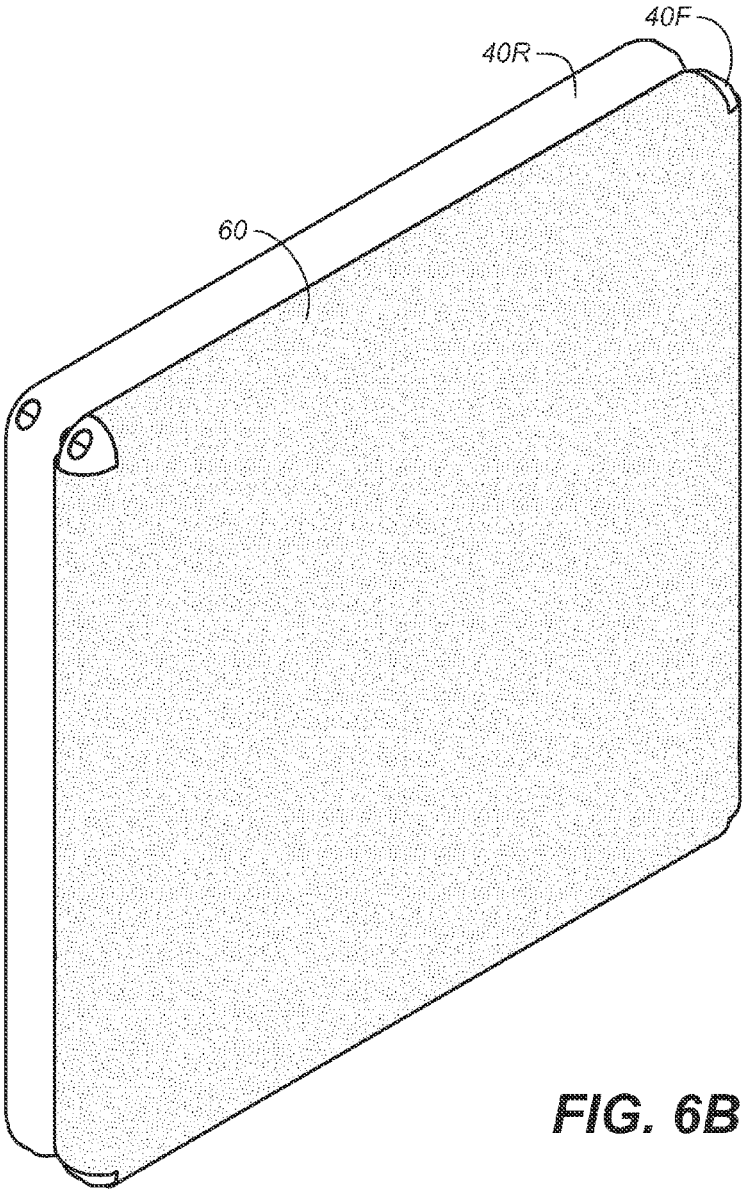
FIG. 6B is an upper perspective view of the acoustically absorptive panel shown in FIG. 6A with the decorative frame removed to reveal stacked dual frame members over which the fabric is mounted and stretched.
Figure 8:
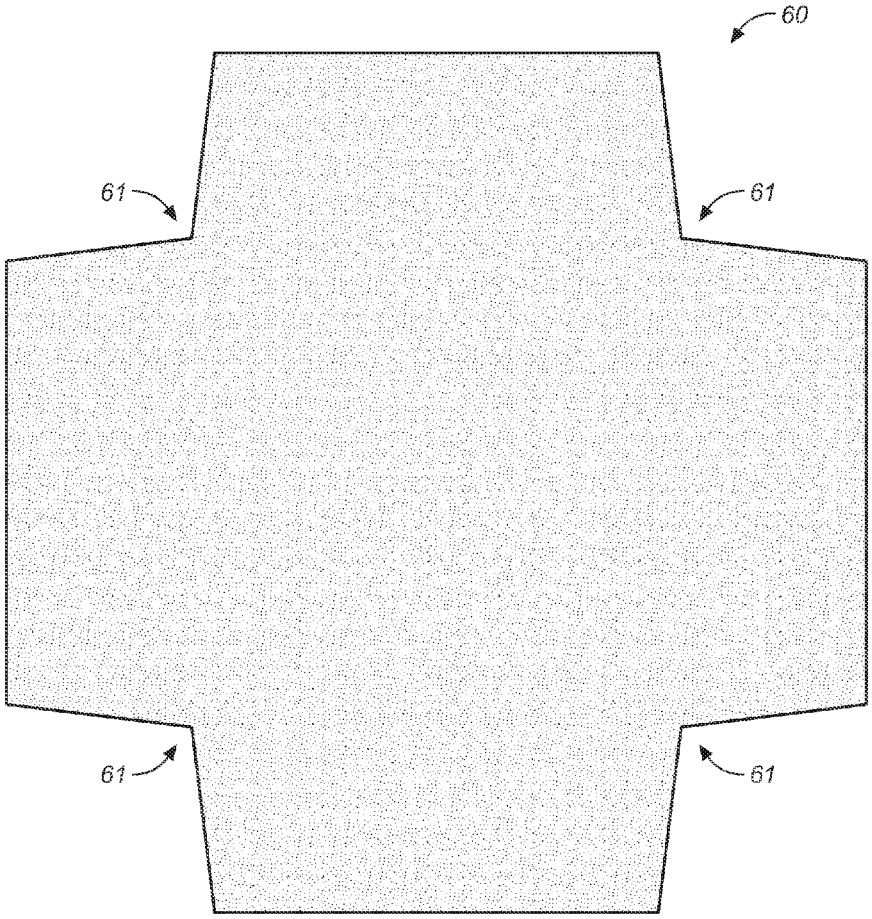
FIG. 8 is a plan view of one embodiment of a front fabric to be used in conjunction with the frame system shown in FIGS. 6A-7B.

In one aspect of the invention seen in FIG. 8, a front fabric 60 is provided with notched corners 61 such as that shown mounted on the frame 40F, 40R in FIG. 6B. Notching the corner of the front fabric 60 advantageously removes corner material which otherwise would bunch together when the fabric is stretch mounted as discussed above.

Figure 12:
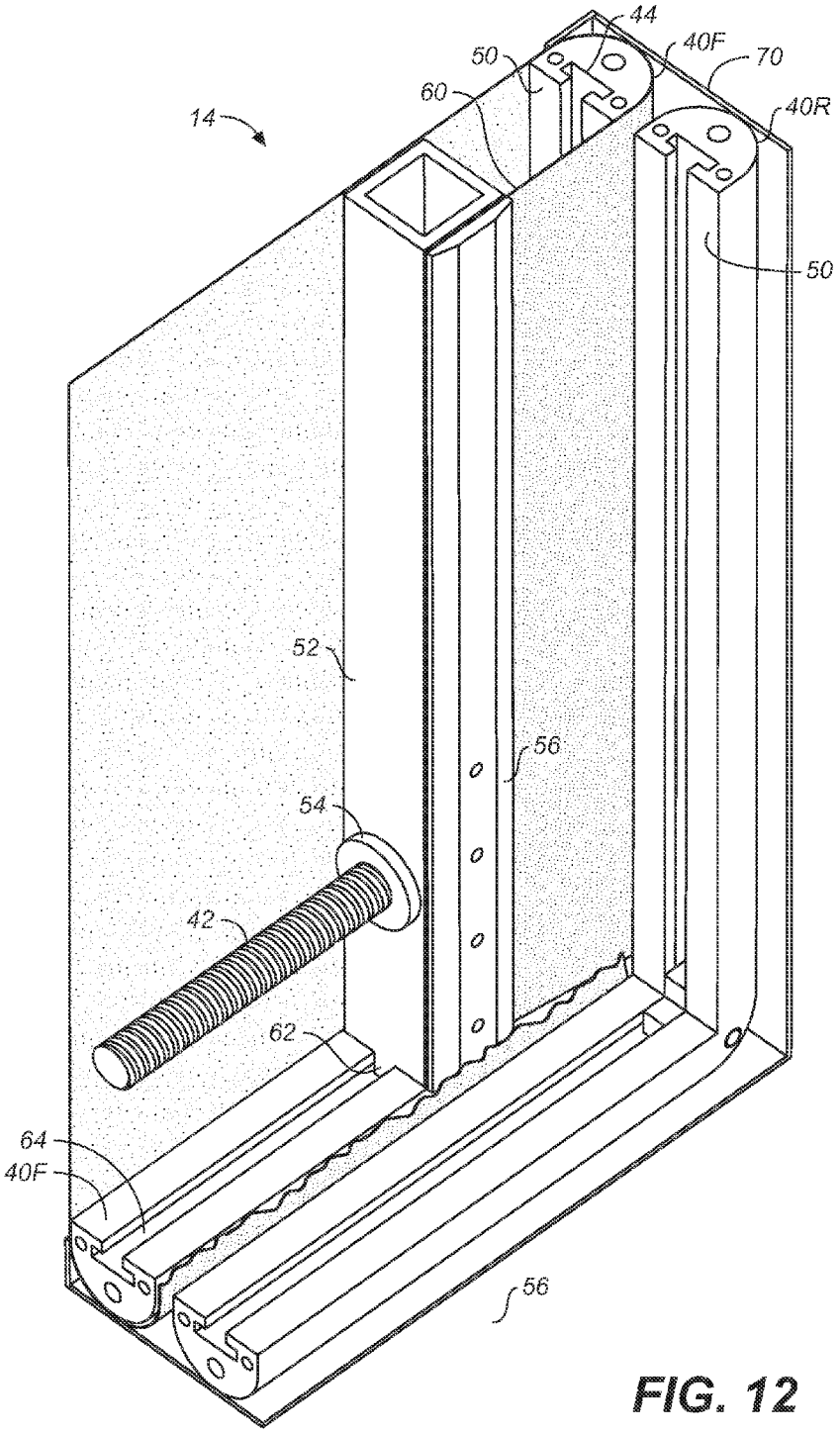
FIG. 12 is a close up perspective view of one corner of the frame members of FIGS. 7A, 7B, 9A, 9B, 10 and 11.

With reference to FIG. 12, a tongue 62 on the end of retaining strut 52 slides in guide channel 64 in the inner edge of horizontally extending frame member 40F to stabilize retaining strut 52 between and as it slides along top and bottom horizontal frame members 40F. A corresponding structure is provided on the retaining struts associated with the rear frame structures 40R.

Although not shown in FIGS. 7A, 7B, 9A, 9B, 11 and 12 for purposes of clearly illustrating the frame mechanism, a porous absorber is disposed within the frame as discussed above in connection with FIGS. 1-3.

Figures 4, 5:
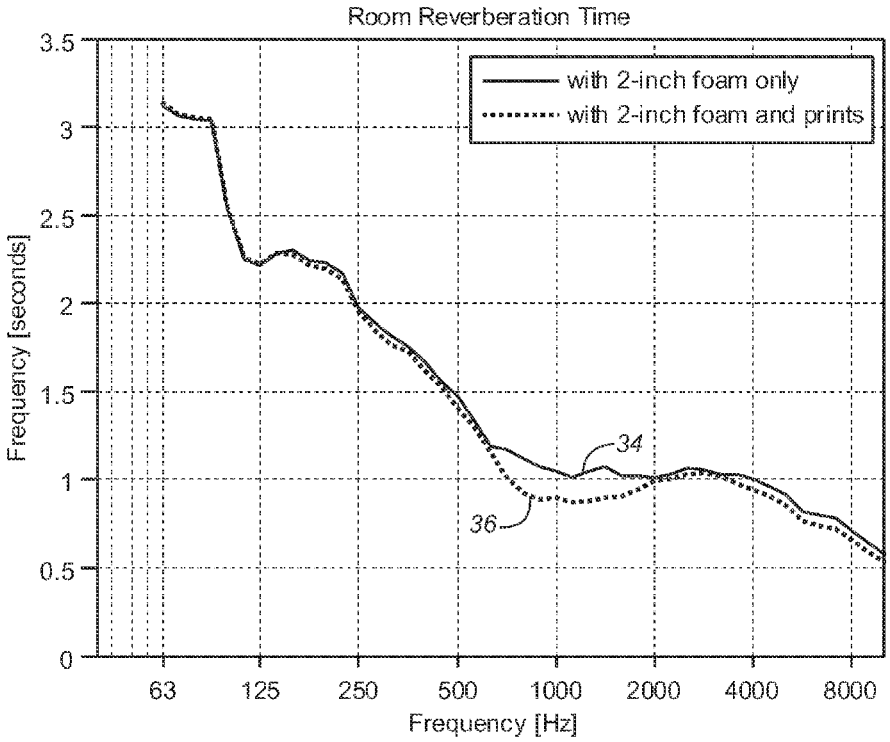
FIG. 4 is a graph showing the additional sound absorption realized by using the invention.
FIG. 5 is a table listing the sound absorption coefficients of the print and air cavity features of the invention.

FIG. 4 shows a graph of the reverberation time measured in a room having a volume of 28,073 square feet. Several specimens of the invention were installed which collectively covered 336 square feet of the wall surfaces of the room with acoustically absorptive wall panels. The specimens each comprised printed stretched front fabric panels mounted over 2" melamine pyramid foam panels. A first measurement 34 was taken with the front fabrics 12 removed, leaving the underlying foam panels 16 exposed. A second measurement 36 was taken with the front fabrics 12 installed according to the invention as discussed above. An additional absorption between 600 Hz and 2000 Hz was observed that is attributable to the forward acoustical absorbing chamber 24 between the printed front fabric 12 and the foam panel 16. FIG. 5 shows the derived absorption coefficients from this particular configuration. A noticeably higher coefficient at 1000 Hz corresponds to the improved acoustical absorption between 600 Hz and 2000 Hz shown in FIG. 4. Those of skill in the art will understand that the range in which additional absorption can be realized will be lowered by increasing the distance between the front fabric 12 and the underlying foam panel 16.

Spacing the front fabric 12 from the pyramid foam panel 16 creates sound absorption in the mid-to-high frequency range, augmenting the absorption provided by the pyramid foam panel 16 alone. Additional absorption is provided by spacing the foam panel 16 from the wall surface 28. Greater sound absorption beneficially results in reduced reverberation in the room, providing increased speech intelligibility and sound clarity. Traditional acoustic panels are limited to solid colors or patterned fabrics. Since the front fabric is printable, it provides more aesthetic flexibility since it can be in the form of artwork or a photograph, while still functioning as an element of an acoustic absorber. The ability to vary the spacing of the frame and fabric from the wall, and to vary the thickness of the pyramid foam enables the frequency range of absorption to be adjusted. Finally, by mounting the foam panel 16 and printed front fabric 12 on a single support frame 14, the resulting acoustically absorptive wall panel may be hung from brackets on a wall surface. The invention provides an improved ability over prior art entire wall acoustical systems by being able to hang decorative prints having acoustical absorption properties in a room.

There have thus been described certain preferred embodiments of an acoustically absorptive panel. While preferred embodiments have been described and disclosed, it will be recognized by those with skill in the art that modifications are within the true spirit and scope of the invention. The appended claims are intended to cover all such modifications.

We claim:

1. An acoustically absorptive panel comprising:

a porous acoustical absorber having a planar configuration and a front facing, a support frame for mounting on a planar surface, said support frame including one or more frame structures, each of said one or more frame structures having one or more pairs of parallel, spaced apart, frame side members, each of said frame side members having a forward face and a side face, an acoustically transparent front fabric stretch-mounted on said support frame in parallel alignment with the front facing of said porous acoustical absorber, said front fabric having one or more pairs of oppositely disposed end panels, a forward air space bounded by the front facing of said porous acoustical absorber and said front fabric, said forward air space having a depth defined by the distance between the front facing of said porous acoustical absorber and said front fabric, said porous acoustical absorber, said air space and said front fabric collectively forming and acting as a forward acoustical absorbing chamber capable of absorbing a range of sound frequencies, one or more tension adjusters connected to one pair of frame side members of each of said one or more frame structures, and a pair of spaced apart retaining struts disposed inwardly from and parallel to one pair of frame side members of each of said one or more frame structures and operatively connected to one of said one or more tension adjusters, so that by manipulation of said tension adjuster the distance between said pair of retaining struts can be adjusted, each end panel of each of said one or more pairs of end panels of said front fabric extending across the forward face and around the side face of one of said frame side members and secured to one of said retaining struts, wherein, by manipulating said one or more tension adjusters, said front fabric may be stretched across said one or more frame structures or relaxed.

2. The acoustically absorptive panel of claim 1 wherein:

said one or more frame structures comprise a front frame structure and rear frame structure affixed to and in parallel alignment with said front frame structure, the one or more pairs of frame side members of said front frame structure spaced apart from the one or more pairs of frame side members of said rear frame structure an amount sufficient for one of the end panels of said front fabric to be freely interposed between them.

3. The acoustically absorptive panel of claim 2 wherein:

said front and rear frame structures have a rectilinear geometry.

4. The acoustically absorptive panel of claim 1 wherein:

said front fabric has no more than 1.0 dB of attenuation in any one-third octave band from frequencies of 2500 Hz and lower, no more than 2.0 dB of attenuation in the 3150 Hz one-third octave band and above, and a texture capable of retaining a printed graphic image.

5. The acoustically absorptive panel of claim 1 wherein:

said front fabric includes one or more notched corners between adjoining pairs of end panels.

6. The acoustically absorptive panel of claim 1 further comprising:

a motor for operating each of said one or more tension adjusters.

7. The acoustically absorptive panel of claim 6 further comprising:

said motor is remotely controllable.

8. The acoustically absorptive panel of claim 1 wherein:

said one or more tensions adjusters comprise one or more lead screws, each of said lead screws interconnecting the pair of frame side members of one of said one or more frame structures, each of said lead screws having two opposite sides, each side having an end and screw threads forming a mirror image of the screw threads on the other side, the end of each side rotatably affixed to one of said frame side members, each of said retaining struts including one or more ball nuts, each side of each of said lead screws threadedly engaged with one of the one or more ball nuts of one of said retaining struts.

9. The acoustically absorptive panel of claim 8 wherein:

each of said lead screws includes a ratchet for turning said lead screw.

10. The acoustically absorptive panel of claim 1 wherein:

each of said retaining struts having one or more clamping plates for securing one of the end panels of said front fabric to said retaining strut.

11. The acoustically absorptive panel of claim 1 wherein:

each of said frame side members has an inner face include a guide channel, and each of said retaining struts has two opposite ends, each of said ends having a tongue slidingly disposed in the guide channel of one of the frame side members of a pair of said frame side members.

12. An acoustically absorptive panel comprising:

a porous acoustical absorber having a planar configuration and a front facing, a support frame for mounting on a planar surface, said support frame including front and rear frame structures each having a rectilinear configuration, each of said front and rear frame structures having a pair of parallel, spaced apart, frame side members, said frame side members each having a forward face and a side face, an acoustically transparent front fabric stretch-mounted on said support frame in parallel alignment with the front facing of said porous acoustical absorber, said front fabric having no more than 1.0 dB of attenuation in any one-third octave band from frequencies of 2500 Hz and lower, no more than 2.0 dB of attenuation in the 3150 Hz one-third octave band and above, and a texture capable of retaining a printed graphic image, a forward air space bounded by the front facing of said porous acoustical absorber and said front fabric, said forward air space having a depth defined by the distance between the front facing of said porous acoustical absorber and said front fabric, said porous acoustical absorber, said air space and said front fabric collectively forming and acting as a forward acoustical absorbing chamber capable of absorbing a range of sound frequencies, a plurality of lead screws interconnecting each of said pairs of frame side members, each of said lead screws having two opposite sides, each said side having an end and screw threads forming a mirror image of the screw threads on the opposite side, each end of said lead screw rotatably affixed to one of said frame members, and a pair of tensioning struts disposed inwardly from and parallel to each of said pairs of frame side members, a ball nut firmly affixed to said tensioning strut, one of said plurality of lead screws threadedly received in each one of said ball nuts, each of said tensioning struts having one or more clamping plates for securing one end of said front fabric to said tensioning strut, each said side of said fabric extending across the forward face and around the side face of one of said frame side members, said side of said fabric secured to one of said tensioning struts, wherein, by rotating said lead screws in a selected direction, said front fabric may be stretched or relaxed across said frame structures.

* * * * *